US007571903B2

(12) United States Patent
Desfosses et al.

(10) Patent No.: US 7,571,903 B2
(45) Date of Patent: Aug. 11, 2009

(54) MOBILE HOPPER SYSTEM

(75) Inventors: Michael David Desfosses, Deerfield, NH (US); James Clyde Folsom, Sanford, ME (US); Glen Roger Caron, Greenland, NH (US); Glenn Alan Guaraldi, Kingston, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 11/894,496

(22) Filed: Aug. 20, 2007

(65) Prior Publication Data

US 2008/0042336 A1 Feb. 21, 2008

Related U.S. Application Data

(60) Provisional application No. 60/838,784, filed on Aug. 18, 2006.

(51) Int. Cl.
*B65H 5/00* (2006.01)

(52) U.S. Cl. ..... 270/52.2; 270/52.21; 270/52.22; 270/52.26; 270/52.29

(58) Field of Classification Search ..... 270/52.14, 270/52.16, 52.19, 52.2, 52.21, 52.22, 52.26, 270/58.29; 198/861.1

See application file for complete search history.

(56) References Cited

U.S. PATENT DOCUMENTS

| | | | | | |
|---|---|---|---|---|---|
| 3,466,026 | A * | 9/1969 | Heigl | 270/58.03 |
| 3,926,423 | A * | 12/1975 | Merker et al. | 270/52.16 |
| 4,177,979 | A * | 12/1979 | Orsinger et al. | 270/52.16 |
| 4,196,835 | A * | 4/1980 | Schlough | 227/81 |
| 5,100,116 | A * | 3/1992 | Graushar | 270/1.02 |
| 6,082,724 | A * | 7/2000 | Kahlig et al. | 270/52.14 |
| 6,237,832 | B1 * | 5/2001 | Chung | 228/44.7 |
| 2003/0047857 | A1 * | 3/2003 | Peier | 270/52.16 |
| 2006/0103064 | A1 * | 5/2006 | Sittinger et al. | 270/52.14 |

* cited by examiner

*Primary Examiner*—Gene Crawford
*Assistant Examiner*—Leslie A Nicholson, III
(74) *Attorney, Agent, or Firm*—Davidson, Davidson & Kappel, LLC

(57) ABSTRACT

A hopper assembly is provided including a hopper, a hopper base, the hopper being detachable from the hopper base, and a hopper shoe, the hopper shoe being fixable to the hopper and securable to the hopper base. A hopper assembly also is provided including a hopper, a first hopper base, and a second hopper base. The hopper is detachable from the first hopper base and movable to the second hopper base. A gathering device is also provided. A method is also provided.

23 Claims, 4 Drawing Sheets

MOBILE HOPPER SYSTEM

This claims the benefit of U.S. Provisional Application No. 60/838,784, filed on Aug. 18, 2006 and hereby incorporated by reference herein.

BACKGROUND

The present invention relates to printing presses and more particularly to hoppers.

Gathering devices such as perfect binders, saddle stitchers and mailroom inserters may use hoppers or feeders to collect sheet material. A saddle stitcher or perfect binder may for example collect folded printed materials fed from hoppers or feeders onto a saddle or perfect binder conveyor, respectively, to form a magazine or other printed product. In the context of the present application, the term hopper and feeder are used synonymously.

U.S. Pat. No. 4,196,835, purportedly discloses an collating machine which includes a stitcher assembly which stitches a group of signatures while they are moving. A saddle conveyor travels past a collating station and individual signatures are fed from the collating station onto the conveyor to form the group of collated signatures. The conveyor carries the group of collated signatures through the stitcher assembly which binds the signatures in each group together.

U.S. Pat. No. 6,082,724, hereby incorporated by reference herein, describes a signature collating apparatus such as an inserter having a plurality of hoppers or feeders delivering sheet materials to receiving locations on a conveyor.

U.S. Publication No. 2006/0103064 purportedly discloses modular signature feeders that include a frame having a base configured to enable the modular signature feeder to be removably attached to another modular signature feeder or a signature transfer assembly associated with a signature collation feeder assembly.

SUMMARY OF THE INVENTION

In accordance with an embodiment of the present invention, a hopper assembly includes a hopper and a hopper base. The hopper is detachable from the hopper base. A hopper shoe is provided. The hopper shoe is fixable to the hopper and securable to the hopper base.

In accordance with another embodiment of the present invention, a hopper assembly includes a hopper, a first hopper base, and a second hopper base. The hopper is detachable from the first hopper base and movable to the second hopper base.

In accordance with a further embodiment of the present invention, a gathering device includes a plurality of hoppers mounted on a hopper base. At least one hopper has a hopper shoe, the hopper shoe is fixable to the hopper and securable to the hopper base. A gathering conveyor is provided and collects sheet material from the plurality of hoppers. The at least one hopper is detachable from the hopper base.

In accordance with an embodiment of the present invention, a method for moving a hopper includes loosening clamps connecting the hopper to a first hopper base, sliding the hopper from the first hopper base to a second hopper base, securing the hopper to the second hopper base and moving the second hopper base.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Moving hoppers around to reconfigure a gathering device may be a time consuming activity that significantly reduces overall productivity. Typically, a hopper is removed or replaced by lifting the hopper off the hopper base with the aid of a crane, forklift or alternative lifting device and may take forty-five minutes to complete. Depending up on the requirements of each print job, hoppers may need to be reconfigured frequently. In addition, specialty hoppers, for example, card feeders, may be necessary for some print jobs but may be removed for other print jobs.

Figure 1:
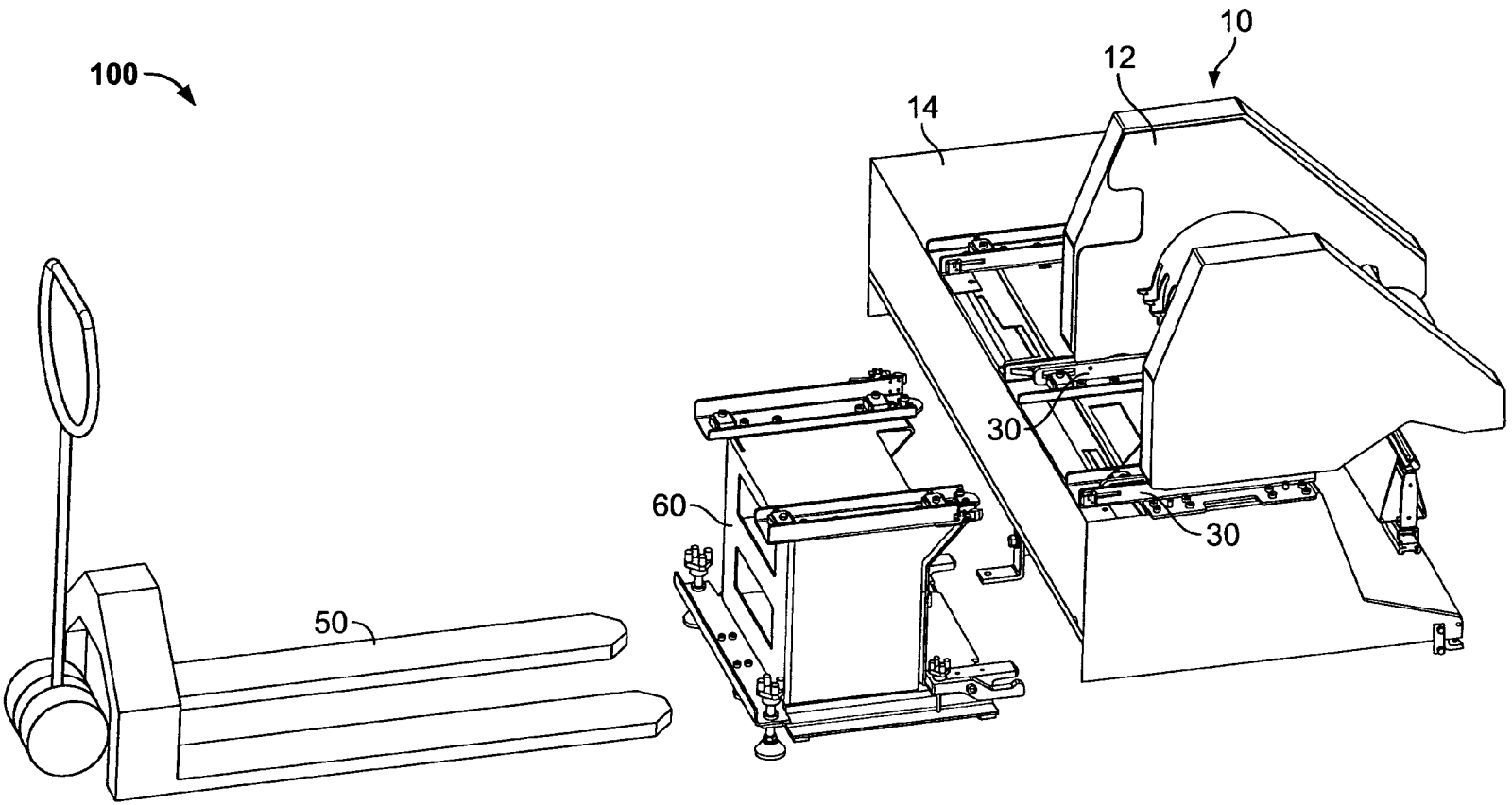
FIG. 1 shows a hopper, a mobile base and a pallet according to the present invention.

FIG. 1 shows a hopper moving assembly 100, a mobile base 60 and a pallet jack 50. A hopper 10 is mounted on a hopper base 14 via hopper shoes 30. Mobile base 60 docks with hopper base 14 to facilitate removal of hopper 10. Hopper 10 includes a hopper sidewall 12. Hopper shoes 30 are secured to hopper sidewall 12.

Figure 2:
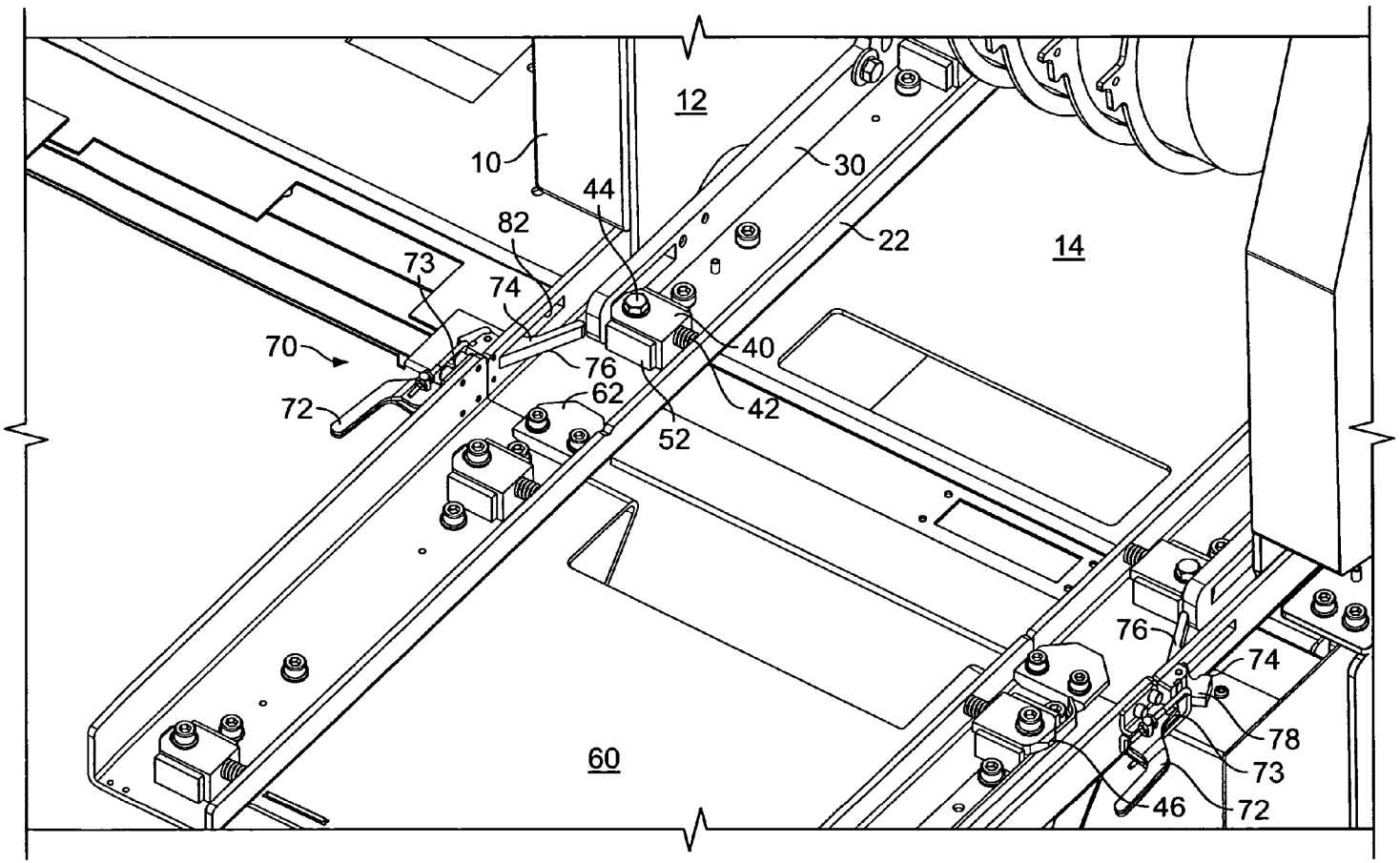
FIGS. 2 and 3 shows details of the hopper and mobile base shown in FIG. 1.

FIG. 2 shows hopper 10 equipped with hopper shoes 30. Hopper shoes 30 are clamped to hopper base 14 via spring-loaded clamps 40. Each spring-loaded clamp 40 includes a spring 42, bolt 44 and chamfered edge 46. Spring-loaded clamp 40 sits in guide 52 and may be bolted into bracket 22 via bolt 44. Bracket 22 is mounted to hopper base 14.

To move hopper 10 from hopper base 14 to mobile base 60, bolts 44 on clamps 40 are loosened. Hopper 10 is then slid onto mobile base 60. Once hopper 10 is on mobile base 60, one or more of bolts 44 may be tightened to secure hopper 10 to mobile base 60. Then pallet jack 50 can be used to move hopper 10 and mobile base 60.

Figure 3:
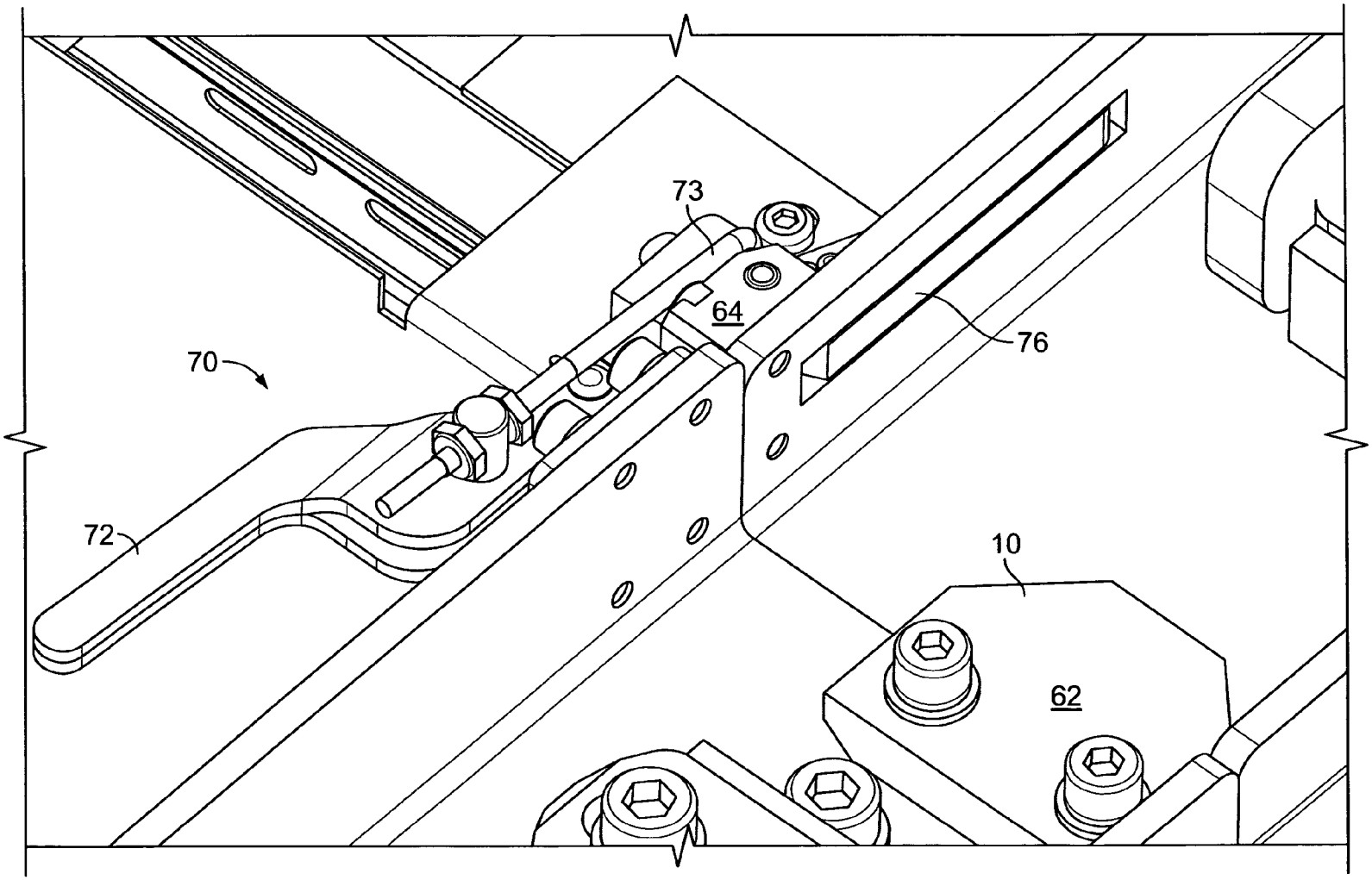

A safety device 70 may be used to prevent hopper 10 from accidentally sliding off mobile base 60 if base 60 is not positioned properly. Safety device 70 includes a toggle clamp 72 and a safety stop lever 74. Safety stop lever 74 includes a protruding portion 76 preventing hopper shoe 30 from sliding backwards accidentally and a hook portion 78. Safety stop lever 74 is spring-loaded into the safety position with protruding portion 76 preventing hopper shoe 30 from sliding off hopper base 114. Toggle clamp 72 includes a "U" bracket 73. When toggle clamp 72 is actuated "U" bracket 73 engages hook 78 and protruding portion 76 is pulled into a slot 82 in bracket 22. Thus, mobile base 60 is pulled into tight engagement with hopper base 14 as shown in FIG. 3. Subsequently, hopper shoe 30 can be slid onto mobile base 60 as shown in FIG. 4.

FIGS. 2 and 3 show alignment guides 62 and pilots 64 used to ensure proper horizontal and vertical alignment between mobile base 60 and hopper base 14.

Figure 4:
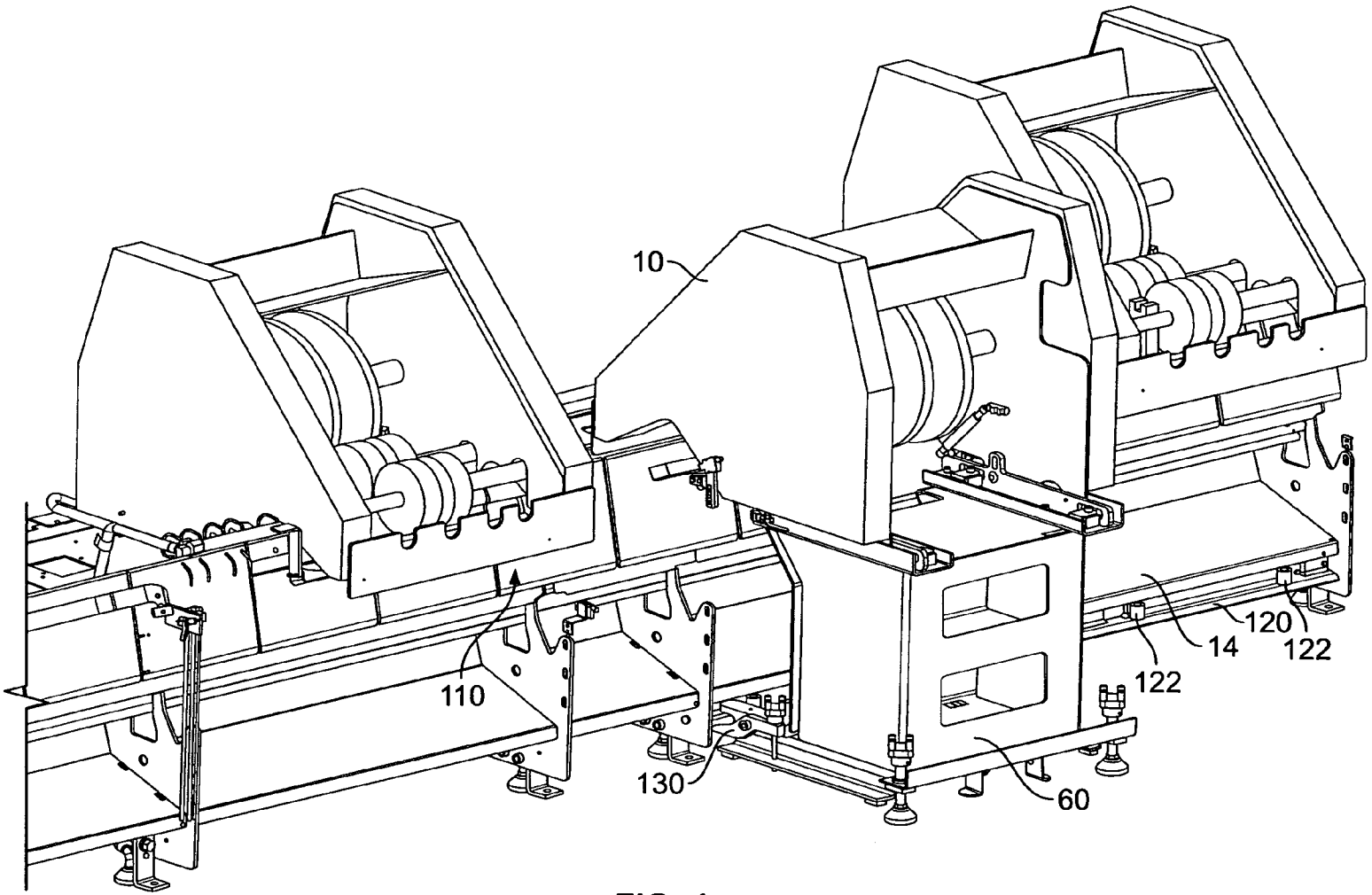
FIG. 4 shows the hopper mounted on the mobile base.

FIG. 4 shows hopper 10 mounted on mobile base 60 and positioned over gathering conveyor. In this example, the gathering conveyor is a gathering chain 110. Hopper 10 has been moved from the typical feeder side position to the operator side, allowing, for example, hopper 10 to feed reverse lap signatures with less difficulty. An operator side of hopper base 14 is fitted with a rail 120. A clamp 130 on mobile base 60 latches onto rail 120. Vibration of hopper 10 is reduced by securing mobile base 60 to hopper base 14 via rail 12 and clamp 130. Rail 120 is fitted with alignment pins 122 to aid in proper placement of mobile base 60 over gathering chain 110.

A hopper as defined herein may include specialty feeders, for example, card feeders. Hoppers may be used in gathering devices such as perfect binders, saddle stitchers and mail-room inserters.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A hopper assembly comprising:

a hopper for feeding materials to a conveyor;

a hopper base, the hopper being detachable from the hopper base;

a hopper shoe, the hopper shoe being fixable to the hopper and securable to the hopper base and permitting the hopper to slide perpendicular to the conveyor; and a spring-loaded clamp for securing the hopper shoe to the hopper base.

2. The hopper assembly as recited in claim 1 wherein the spring-loaded clamp includes a spring, a chamfered edge and a bolt for securing the clamp to the hopper base.

3. The hopper assembly as recited in claim 1 further comprising a safety device for preventing the hopper shoe from sliding off the hopper base.

4. The hopper as recited in claim 1 wherein the hopper shoe includes a bearing surface for sliding the hopper off the hopper base.

5. A hopper assembly comprising:

a hopper for feeding materials to a conveyor;

a first hopper base;

a second hopper base; and a rail on an operator side of the first hopper base;

hopper being detachable from the first hopper base in a direction perpendicular to the conveyor and movable to the second hopper base.

6. The hopper assembly as recited in claim 5 further comprising a toggle clamp for aligning the second hopper base with the first hopper base prior to moving the hopper to the second hopper base.

7. The hopper assembly as recited in claim 5 further comprising a safety device for preventing the hopper shoe from sliding off the hopper base.

8. The hopper assembly as recited in claim 5 further comprising a pallet jack for moving the second hopper base.

9. The hopper assembly as recited in claim 5 further comprising a hopper shoe, the hopper shoe being fixable to the hopper and securable to the first or second hopper base.

10. The hopper as recited in claim 9 wherein the hopper shoe slides off the first hopper base and slides onto the second hopper base.

11. The hopper assembly as recited in claim 10 further comprising a spring-loaded clamp for securing the hopper shoe to the first or second hopper base.

12. The hopper assembly as recited in claim 11 wherein the spring-loaded clamp includes a spring, a chamfered edge and a bolt for securing the clamp to the first or second hopper base.

13. The hopper assembly as recited in claim 5 further comprising alignment guides for aligning the second hopper base with the first hopper base.

14. The hopper assembly as recited in claim 5 wherein the rail includes alignment pins.

15. The hopper assembly as recited in claim 5 wherein the second hopper base includes a latch for securing the second hopper base to the rail.

16. A method for moving a hopper comprising the steps of:

loosening clamps connecting the hopper to a first hopper base;

sliding the hopper from the first hopper base to a second hopper base;

securing the hopper to the second hopper base; and moving the second hopper base.

17. The method as recited in claim 16 further comprising the step of:

aligning the second hopper base to the first hopper base prior to the step of sliding the hopper from the first hopper base to the second hopper base.

18. method as recited in claim 16 further comprising the step of:

disengaging a safety device prior to the step of sliding the hopper from the first hopper base to the second hopper base.

19. The method as recited in claim 16 wherein moving the second hopper base includes lifting the second hopper base using a pallet jack.

20. A hopper assembly comprising:

a hopper for feeding materials to a conveyor;

a first hopper base;

a second hopper base, the hopper being detachable from the first hopper base in a direction perpendicular to the conveyor and movable to the second hopper base; and a toggle clamp for aligning the second hopper base with the first hopper base prior to moving the hopper to the second hopper base.

21. A hopper assembly comprising:

a hopper for feeding materials to a conveyor;

a first hopper base;

a second hopper base; the hopper being detachable from the first hopper base in a direction perpendicular to the conveyor and movable to the second hopper base;

a hopper shoe, the hopper shoe being fixable to the hopper and securable to the first or second hopper base, the hopper shoe sliding off the first hopper base and sliding onto the second hopper base; and a spring-loaded clamp for securing the hopper shoe to the first or second hopper base.

22. The hopper assembly as recited in claim 21 wherein the spring-loaded clamp includes a spring, a chamfered edge and a bolt for securing the clamp to the first or second hopper base.

23. A hopper assembly comprising:

a hopper for feeding materials to a conveyor;

a first hopper base;

a second hopper base; the hopper being detachable from the first hopper base in a direction perpendicular to the conveyor and movable to the second hopper base; and alignment guides for aligning the second hopper base with the first hopper base.

* * * * *